US007434337B2

(12) United States Patent
Gibert et al.

(10) Patent No.: US 7,434,337 B2
(45) Date of Patent: Oct. 14, 2008

(54) FOOTWEAR ITEM COMPRISING BUILT-IN DYNAMIC ELEMENT

(75) Inventors: Xavier Gibert, Chassieu (FR); Francis Lepage, Dommartin (FR); Bertrand Barre, Lapeyrouse (FR)

(73) Assignee: The Zebra Company, Limonest (FR)

( * ) Notice: Subject to any disclaimer, the term of this patent is extended or adjusted under 35 U.S.C. 154(b) by 0 days.

(21) Appl. No.: 10/527,022

(22) PCT Filed: Sep. 9, 2003

(86) PCT No.: PCT/FR03/02680

§ 371 (c)(1),
(2), (4) Date: Apr. 8, 2005

(87) PCT Pub. No.: WO2004/021819

PCT Pub. Date: Mar. 18, 2004

(65) Prior Publication Data

US 2005/0246922 A1 Nov. 10, 2005

(30) Foreign Application Priority Data

Sep. 9, 2002 (FR) ..... 02 11134

(51) Int. Cl.
*A43B 13/28* (2006.01)

(52) U.S. Cl. ..... 36/27; 36/25 R

(58) Field of Classification Search ..... 36/27, 36/28, 25 R
See application file for complete search history.

(56) References Cited

U.S. PATENT DOCUMENTS

| | | | | |
|---|---|---|---|---|
| 4,592,153 | A * | 6/1986 | Jacinto | 36/38 |
| 4,858,338 | A | 8/1989 | Schmid | |
| 5,572,805 | A | 11/1996 | Giese et al. | |
| 6,282,814 | B1 * | 9/2001 | Krafsur et al. | 36/27 |
| 6,393,731 | B1 * | 5/2002 | Moua et al. | 36/27 |

FOREIGN PATENT DOCUMENTS

| | | | |
|---|---|---|---|
| DE | 199 55 550 | A1 | 12/2000 |
| GB | 2 256 784 | A | 12/1992 |
| WO | WO 00/72713 | A1 | 12/2000 |

* cited by examiner

*Primary Examiner*—Ted Kavanaugh
(74) *Attorney, Agent, or Firm*—Oliff & Berridge, PLC

(57) ABSTRACT

The invention relates to a shoe or footwear item comprising a sole consisted of an outer face which is intended to come into contact with the ground and an inner face which is intended to come into contact with the foot of the user. According to the invention, the sole includes a dynamic support element which comprises at least two elastically-deformable elements and which is used to store and release energy when said sole is subjected to later stresses. The dynamic support element is positioned in the sole such that it expands at least partially beneath the area corresponding to the front part of the foot. In this way, a dynamic interaction is produced between the two elastically-deformable elements when the sole is subjected to stresses and two corresponding lateral ground support points are obtained, which are located on either side of the longitudinal axis of the shoe.

18 Claims, 4 Drawing Sheets

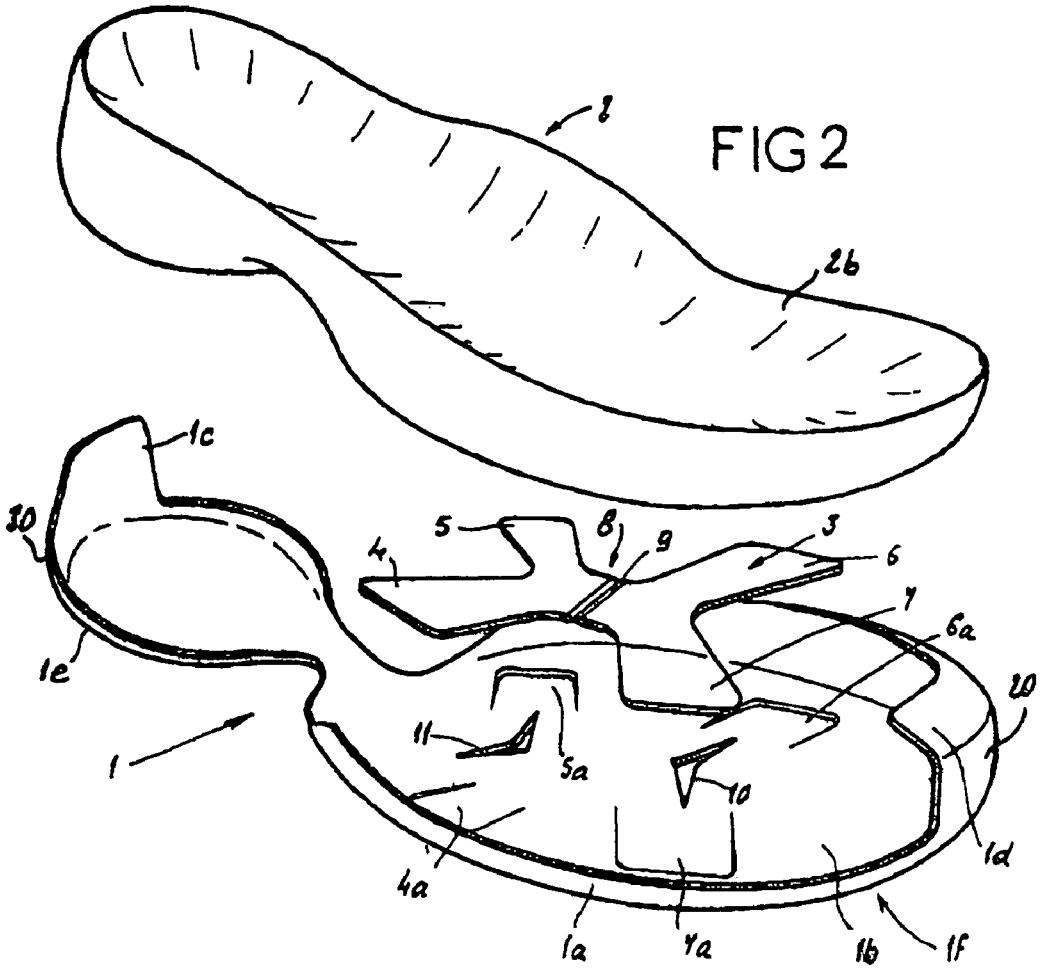
FIG 2
FIG 3
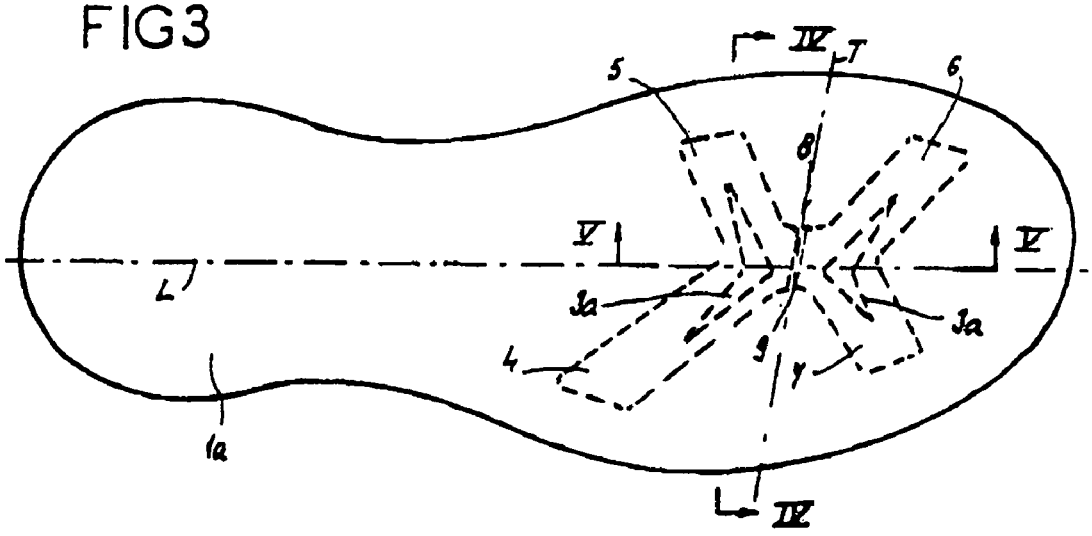

FOOTWEAR ITEM COMPRISING BUILT-IN DYNAMIC ELEMENT

The present invention relates to the technical field of shoes, and more particularly to items of footwear for all kinds of sport.

Such shoes are subjected to considerable mechanical stresses, in particular when playing sports in which the transfers of weight on the side spring elements are frequent, such as tennis, golf, basketball, football and the like.

The present invention relates more particularly to a sole for such shoes, since this is the part which takes extreme stresses and strains, while ensuring optimum comfort for the wearers of this footwear.

It is known practice to make shoe soles, for example for sports shoes having a sole whose outer face is intended to come into contact with the ground and whose inner face is intended to come into contact with the foot of a wearer.

Shoes having such a sole which also houses a dynamic, elastically deformable element are also known.

Document EP 0 516 874 describes a shoe in which the front part of the sole is provided with an insert, of the Belleville washer type, for storing and releasing energy when walking.

Such a sole is in no way suitable for the above sports, in which the lateral stresses to which the sole and the shoe are subjected are much more intense and distributed differently than in a conventional walking shoe, such as that described in that document.

The aim of the present invention is to produce a sole for a shoe intended for extreme use, in which the side supports of said sole are highly stressed, so as to encourage the sole and the foot to return to a substantially normal or antagonist position by reducing energy losses in lateral weight transfers of the front part of the foot.

According to the invention, the above type of footwear item is essentially characterized in that the sole comprises a dynamic support element which comprises at least two elastically deformable components or parts, for storing and releasing energy when said sole is subjected to lateral stresses, said dynamic support element being positioned in the sole such that it lies at least partially beneath a zone corresponding to the front part of the foot, so as to produce a dynamic interaction between the two elastically deformable components or parts when said sole is subjected to stresses and to create two respective corresponding lateral points of bearing on the ground, which are located on either side of the longitudinal axis of the shoe.

Preferably, the dynamic support element comprises a spring plate, positioned in the sole such as to lie at least partially beneath a zone corresponding to the arch of the foot, and at least partially beneath a zone corresponding to the front part of the foot, so as to produce a dynamic interaction between the two parts of the sole thus defined.

Advantageously, the two support components or parts are joined or arranged on the spring plate.

More preferably still, the dynamic support element comprises at least one set of two support components or parts, arranged longitudinally on either side of the metatarsus support zone.

According to one embodiment of the sole according to the invention, the spring plate comprises at least four arms, defining an X shape for example, each of the arms bearing on a pad.

As a variant, the four arms are joined together.

In yet another variant, the four arms are joined together in pairs to constitute two independent pairs.

Preferably, the pads are located on and in the region of the periphery of an inner face of an outer layer of the sole, so as to define four zones of bearing on the ground, on the inner face.

According to one embodiment, each pad is an attached compressible piece.

According to one embodiment, the plate has a central part extending longitudinally with respect to a longitudinal axis (L) of the sole, the arms extending obliquely toward the pads from said central part.

According to one embodiment, the central part has a transverse groove, located in said sole in the zone corresponding to the position of the metatarsus, thus allowing elastic deformation of the plate along an axis substantially normal to the longitudinal axis.

According to one embodiment, the plate has thicker parts, at least locally.

The thicker parts are for example made of an elastic material and are locally thinned.

According to one embodiment, the lateral supports constitute antagonist paired supports.

According to one embodiment, the dynamic element is a spring plate with shape memory.

According to one embodiment, the plate is fastened by adhesive bonding to the inner face of the outer layer.

According to one embodiment, the spring plate is situated between the outer layer and an intermediate layer, which are separated at least locally.

The arms of the spring plate are for example made as a single piece.

Preferably, the spring plate comprises at least one V-shaped piece.

As a variant, the spring plate comprises at least two V-shaped pieces assembled in opposition.

The present invention also aims to provide a shoe or footwear item comprising a sole extending in a longitudinal direction, from a front end to a rear end, whose outer face is designed to come into contact with the ground and whose inner face is designed to support the foot directly, characterized in that said sole comprises an element for the dynamic support of the lateral movement of the foot in any direction transverse to the longitudinal direction, said element being arranged at least in the front part of the foot and extending in a direction perpendicular to the plane of the sole, or its thickness, between the outer face (including the latter) and the inner face (including the latter) of said sole, said element comprising at least two support components or parts for the front part of the foot, arranged in the front part of the sole respectively on either side of the longitudinal direction, and aligned in a transverse direction, each support component being elastically deformable in a direction perpendicular to the plane of the sole, short of (compression) and beyond (expansion) a nominal position or conformation under the effect of the weight of the body, via the foot, respectively when the foot bears laterally on either of the support components and when said bearing force ceases.

Advantageously, the support components or parts are independent of one another.

As a variant, the support components or parts are mechanically integral.

Preferably, the structure of the sole is a multi-component structure.

In yet another variant, the structure of the sole is a one-piece structure.

One advantage of the shoe according to the invention lies in mechanical support for the reactivity of the front of the foot.

The shoe according to the present invention thus allows lateral dynamic support for the reactivity of the front of the foot, by encouraging easier and faster springing back during the bearing phases. Specifically, the dynamic element makes it possible to cause, at the front of the foot, the parts for bearing on the ground which are in opposition to react. On either side of the metatarsus support zone, the support parts are thus one compressed, the other relaxed.

The dynamic element advantageously allows better control of the loads of the front of the foot during lateral weight transfers. The wearer feels his weight distribution better such that he has better control over it.

Moreover, the present invention makes it possible to achieve greater speed in lateral weight transfers, the support being amplified.

The shoe sole according to the present invention also provides greater horizontal stability for the front of the foot, by improving foot suspension.

Further features and advantages will also become clear from the following detailed description, with reference to the drawings attached by way of illustrative example, in which:

FIG. 2 is an exploded view of an embodiment of a sole according to the invention;

FIG. 3 is a view from beneath of the sole of FIG. 2;

Figure 1:
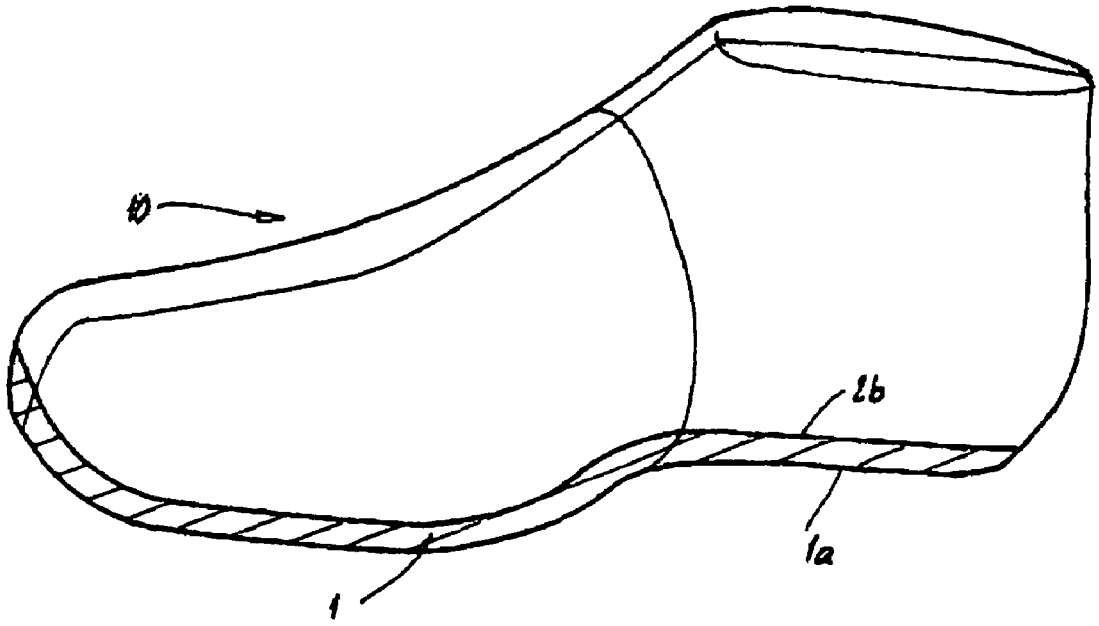
FIG. 1 is a perspective view of a shoe or footwear item for racket sports, having a sole according to the present invention.

The shoe 10 or footwear item according to the present invention shown in perspective in FIG. 1 is a shoe more particularly designed to be worn when playing sports such as tennis, squash, golf, or alternatively badminton. Naturally, the shoe 10 according to the present invention may be worn for other sports without restriction.

When playing such sports, a person often has to swing his body in lateral movements left to right and vice versa. There are a great many lateral to-and-fro movements throughout the game, and they must be rapid.

The shoe 10 has a built-in sole as shown in FIG. 2 which comprises for example an outer layer 1. The latter has an outer face 1*a* intended to come into contact with the ground and an inner face 1*b*. The outer face 1*a* may be covered with various coverings likely to improve its grip on the ground. The sole extends between a front end 20 and a rear end 30, in a longitudinal direction L.

The sole of FIG. 1 also comprises an intermediate layer 2 intended to be placed on top of the outer layer 1, and on which is placed an additional sole called an inlay sole (not shown). This intermediate layer has an inner face 2*b* intended to come into contact with the wearer's foot. The outer layer 1 may also be provided locally with upright edges 1*c*, 1*d*, between which the intermediate layer 2 is placed.

According to an essential feature of the present invention, the dynamic element takes the form of a spring plate 3 placed in the sole, at a level which depends on the internal structure of the sole. The function of this plate is independent of the number of strata of which the sole is composed, it only matters that the wearer can bear on this plate when playing, in particular during lateral spring movements.

Between the outer layer 1 and the intermediate layer 2 is placed, for example, the spring plate 3 forming a dynamic support element of the sole. Such a dynamic element makes it possible to store and release energy generated by considerable mechanical stresses and strains of the shoe and hence of the sole, i.e. as the foot moves laterally in a transverse direction T which is substantially perpendicular to the longitudinal direction L.

The spring plate 3 is for example fastened by adhesive bonding to the inner face 1*b*.

The intermediate layer 2 is attached to the outer layer 1, more particularly fastened to the inner face 1*a* of the latter, so as to create the sole according to the invention.

The outer layer 1 and the intermediate layer 2 are separated at least locally, particularly in the region of the spring plate 3. The intermediate layer 2 is fastened to the outer layer 1 at a part 1*e* forming the heel of the sole and at the periphery or upright edges 1*c*, 1*d* of a front part 1*f*.

The spring plate 3, shown in particular in FIGS. 2 and 3, comprises four arms 4, 5, 6 and 7 joined together and defining for example an X shape.

Each of the arms 4, 5, 6 and 7 bears on a corresponding pad 4*a*, 5*a*, 6*a* and 7*a*, located on and in the region of the periphery of the inner face 1*b*.

The pads 4*a*, 5*a*, 6*a* and 7*a* thus define four lateral zones of bearing on the ground, on the inner face 1*b*.

Figure 5:
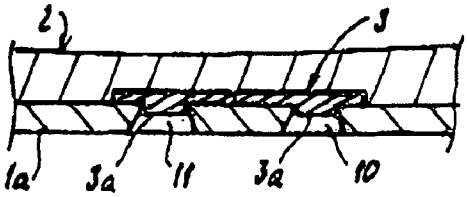
FIG. 5 is a section along the line V-V in FIG. 3.
Figure 6:
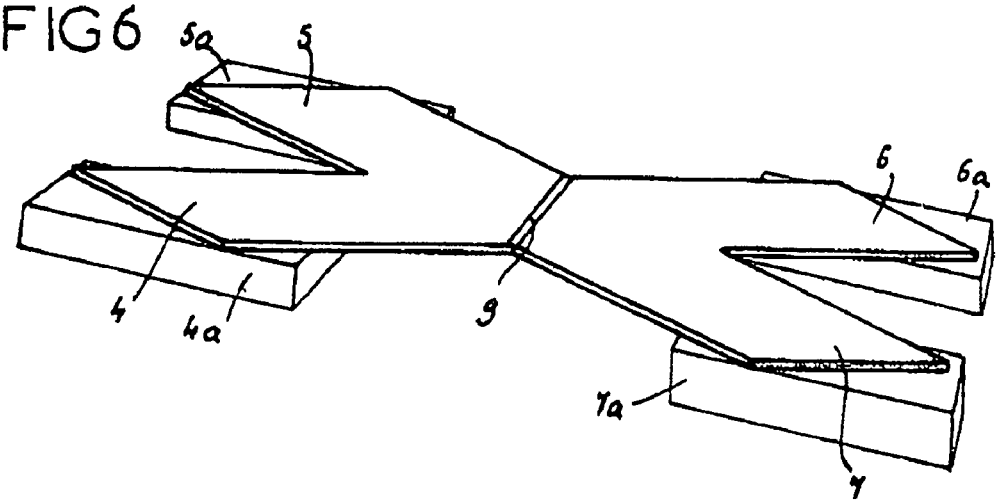
FIGS. 6 and 7 are schematic depictions of an example of how a dynamic element of a sole according to the invention works.

Each pad 4*a*, 5*a*, 6*a* and 7*a* consists for example of a compressible piece attached to the inner face 1*b* (cf. FIGS. 5 and 6).

As a variant, each of the pads may be made by a slight deformation, thicker part or clearance of material on the inner face 1*b*, serving to position the ends of the respective arms 4, 5, 6 and 7.

Moreover, the pads 4*a* to 7*a* may, as a variant, be located not underneath the arms but situated above the arms of the plate.

The spring plate 3 preferably has a central part 8 extending longitudinally with respect to a longitudinal axis L of the sole.

The arms 4, 5, 6 and 7 extend obliquely from said central part 8 toward the corresponding pads 4*a*, 5*a*, 6*a* and 7*a*.

According to the invention, the arms 4 to 7 extend on either side of the longitudinal axis defined by the metatarsus support zone so that the pads are situated on either side of this axis. Two pairs of pads are thus defined, one consisting of the pads 4*a* and 5*a*, and the other of the pads 6*a* and 7*a*. Within each of these pairs, the pads interact in opposition to allow the foot to spring back laterally.

Thus, when the pad 4*a* is compressed, the opposite pad 5*a* is relaxed, and vice versa. The same goes for the pair of pads 6*a* and 7*a*.

The pads may also be considered as support zones or components. They may be either independent of one another or mechanically integral.

The central part 8 also has a transverse groove 9, extending in the sole, following a zone corresponding to the position of the metatarsus, when the spring plate 3 is fastened to the inner face 1*b*.

This groove 9 thus allows the spring plate 3 to deform elastically, along an axis substantially normal to the longitudinal axis L and coinciding with said groove 9.

In one embodiment, the spring plate 3 also has thicker parts 3*a*.

Figure 4:
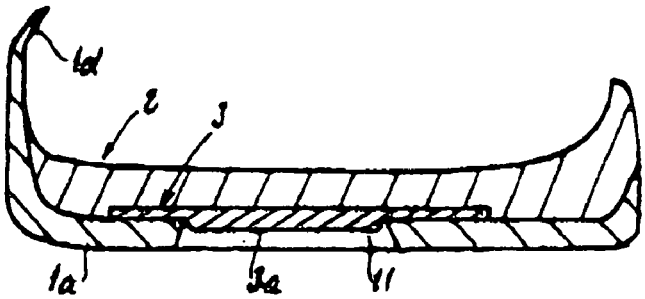
FIG. 4 is a section along the line IV-IV in FIG. 3.

One embodiment of these thicker parts 3*a* is shown for example in FIGS. 2, 3 and 4.

The thicker parts 3*a* are made of a material whose elasticity allows a deformation when one or more of the arms 4 to 7 is compressed and promotes the return to the initial position.

The thicker parts are for example thinner at the center or alternatively arched to enhance the compression/expansion function of the spring plate.

This compression/expansion function can moreover be enhanced by multiplying the lateral bearing points, by for example increasing the number of arms of the spring plate. This makes it possible to obtain an increasingly local reaction to stresses, and even a degree of gradualness in this reaction. This function may also be achieved by creating recesses in the spring plate.

The outer layer 1 is for example provided with openings 10 and 11, in which the thicker parts 3*a* are engaged and positioned.

The openings 10 and 11 may advantageously be covered or filled with a transparent material, making it possible to see, through the outer layer 1, at least part of the spring plate 3.

Likewise, the outer layer 1 may also have complementary transparent zones, facing the pads 4*a*, 5*a*, 6*a* and 7*a* or the ends of the arms 4, 5, 6, 7, so as to make the zones corresponding to the lateral supports visible through the outer face 1*a*.

The spring plate 3 is for example metal or made of a high-performance plastic, or alternatively of a composite.

The intermediate layer 2, and the outer layer 1, are made for example of rubber.

The sole may for example have a one-piece structure such that the dynamic support element is embedded in one of the layers or strata of the sole, or in the single layer.

According to a variant that has not been shown, the intermediate layer 2 may have slits facing the arms 4, 5, 6, 7 in which are placed inserts made of highly deformable and elastic materials (for example elastomer, polyurethane, etc.).

With their elastic properties, these inserts make it possible to improve the springing back of the front of the foot.

The inserts with a shape complementary to the slits preferably have shapes identical or similar to the shapes of the arms 4, 5, 6 and 7.

In yet another variant that has not been shown, the sole may be reduced to a single stratum, and consist for example only of the outer layer 1, the spring plate and the pads being embedded in the latter.

Figure 7:
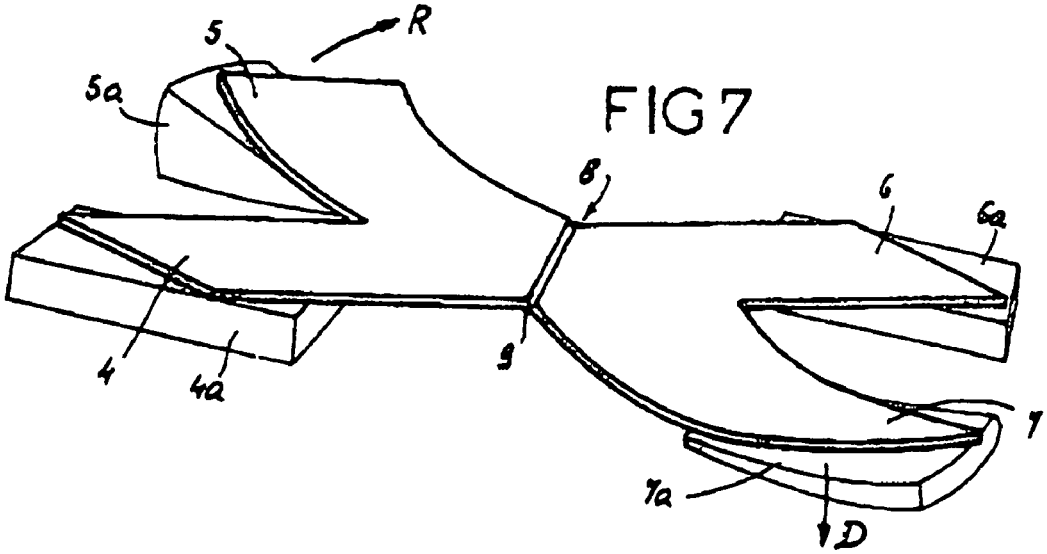

FIGS. 6 and 7 show how the spring plate 3 works.

At rest, i.e. when the sole is not stressed, the spring plate 3 lies substantially flat as shown schematically in FIG. 6.

When the wearer bears laterally at the front with the front part of his foot, shown for example in FIG. 7, the arm 7 is deformed elastically along the arrow D and compresses the pad 7*a*.

At the same time, the arm 5 deforms elastically and antagonistically along the arrow R and expands the pad 5*a*. Likewise, the pad 6*a* opposite the pad 7*a* is relaxed. Likewise, the pad 4*a* may be compressed. The wearer may thus not only cause the dynamic element to be subjected to lateral stresses but also stresses along the diagonal of this element.

The sole thus accompanies the movement of the foot, in particular when the foot bears laterally on the sole. Moreover, the energy stored by virtue of the stressing of the spring plate 3 helps the foot return to another position or a rest position once the abovementioned lateral bearing forces cease.

Each lateral bearing force exerted by the foot may thus be passed on to one of the arms 4, 5, 6, 7 and may thus be supported via the functioning of the spring plate 3.

The arms 4 to 7 of the spring plate 3 are for example made as one piece. As a variant, the spring plate is obtained by fastening together two V-shaped pieces assembled in opposition.

The dynamic support element may be made using any kind of material with elastic properties and take any geometric shape suitable for the sport played with the shoe. The structure of this element must make it possible to create at least two antagonistic lateral supports located on either side of the longitudinal axis L of the shoe, situated in the front part of the sole.

Figure 8:
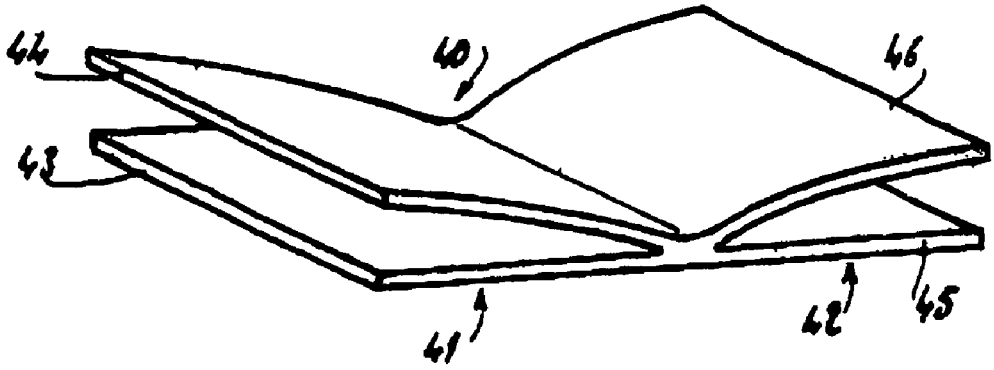
FIGS. 8 to 11 are, respectively, perspective and transverse sectional views of the dynamic element in two variants according to the present invention.
Figure 9:
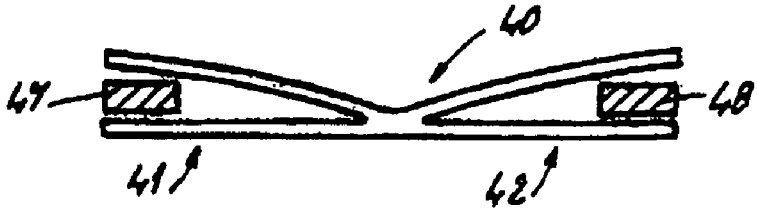

Thus, in another variant as shown in FIGS. 8 and 9, the dynamic support element 40 has constituent parts situated in the direction of the thickness of the sole. It thus has two V-shaped pieces 41, 42 whose respective arms 43, 44 and 45, 46 are situated one on top of the other. Inside each pair of arms are elastic pads 47 and 48 (FIG. 9); as a variant, as shown in FIG. 8, the pads may be dispensed with and be replaced by air. The two pairs are mounted back to back, being joined at the base of the V.

Figure 10:
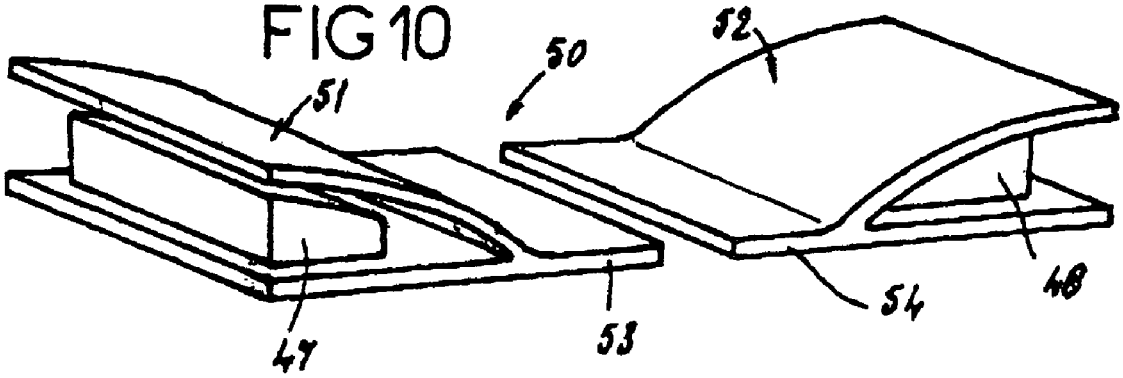
Figure 11:
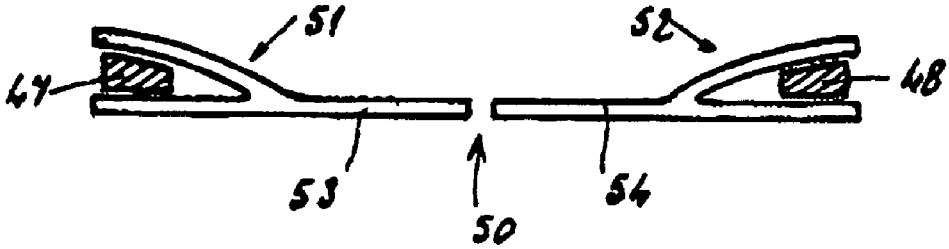

In yet another variant shown in FIGS. 10 and 11, the dynamic element 50 also consists of two pairs 51, 52 of arms which are spaced apart from one another and are in the shape of a V with their respective bases 53, 54 extending over a certain width. The pads 47 and 48 are situated along the longitudinal edges of the shoe, in the front part of the sole.

The shoe sole according to the present invention thus makes it possible to facilitate lateral springing back by reducing energy losses in lateral weight transfers of the front of the foot. The wearer has better control over the stress forces of the front of the foot since he can feel his weight distribution better. Moreover, the horizontal stability of the front of the foot is improved thanks to better suspension. The dynamic element also ensures greater speed in lateral weight transfers by increasing the springing effect.

It goes without saying that the invention is not limited only to the embodiments described above by way of example. On the contrary, it encompasses all variants. Thus, in particular, the features presented above could be combined differently without thereby departing from the scope of the invention.

The invention claimed is:

1. A footwear item comprising:

a sole component extending in a longitudinal direction from a front end of the footwear item to a rear end of the footwear item, wherein an outer face of the sole component is designed to come into contact with the ground and wherein an inner face of the sole component is designed to support a foot of a wearer directly, the sole component comprising a dynamically responsive integral insert in a front part of the sole component, extending in a transverse direction across a longitudinal direction and extending between the outer face and the inner face of the sole component in a plane perpendicular to the sole component, the dynamically responsive integral insert comprising two resilient weight supporting elements respectively disposed on two sides of the longitudinal direction, the resilient weight supporting elements antagonistically acting around the longitudinal direction, each resilient weight supporting element being pivotally arranged around the longitudinal direction to be angularly elastically charged around the longitudinal direction against any local and lateral dynamic loading of a metatarsus part of the foot on either side of the longitudinal direction, caused by a transverse transfer of weight of the wearer from one side to an other side of the footwear item.

2. A footwear item comprising:

a sole component extending in a longitudinal direction from a front end of the footwear item to a rear end of the footwear item, wherein an outer face of the sole component is designed to come into contact with the ground and wherein an inner face of the sole component is designed to support a foot of a wearer directly, the sole component comprising a dynamically responsive integral insert in a front part of the sole component;

wherein the dynamically responsive integral insert is designed for a lateral movement of the foot in any direction transverse to the longitudinal direction, and extending in a transverse direction across the longitudinal direction and extending between the outer face and the inner face of the sole component in a plane perpendicular to a plane of the sole component, and wherein the dynamically responsive integral insert comprises:

at least two resilient weight supporting elements located in a front part of the dynamically responsive integral insert and on opposite sides of an axis extending in the longitudinal direction, and aligned in a transverse direction, each resilient weight supporting element being elastically deformable in a direction perpendicular to the plane of the sole component, and wherein the resilient weight supporting elements antagonistically act around the longitudinal direction, and each resilient weight supporting element being pivotally arranged around the longitudinal direction to be angularly elastically charged around the longitudinal direction against any local and lateral dynamic loading of a metatarsus part of the foot on either side of the longitudinal direction, caused by a transverse transfer of weight of the wearer from one side to an other side of the footwear item.

3. The footwear item as claimed in claim 1, wherein the dynamically responsive integral insert further comprises a spring plate and is positioned in the sole such as to lie at least partially beneath a zone corresponding to an arch of the foot, and at least a part of the front part of the foot.

4. The footwear item as claimed in claim 3, wherein the resilient weight supporting elements are joined on the spring plate.

5. The footwear item as claimed in claim 4, wherein the spring plate comprises at least four arms, defining an X shape, each of the arms bearing on a pad constituting an elastically deformable component.

6. The footwear item as claimed in claim 5, wherein each pad is an attached compressible piece.

7. The footwear item as claimed in claim 5, wherein the spring plate has a central part extending transversely with respect to a longitudinal axis of the sole component, the arms extending obliquely toward the pads from said central part.

8. The footwear item as claimed in claim 7, wherein the central part has a transverse groove, located in said sole component in a zone corresponding to a position of the metatarsus part of the foot, allowing elastic deformation of the spring plate along an axis substantially normal to the longitudinal axis.

9. The footwear item as claimed in claim 5, wherein the spring plate has thicker parts, at least locally.

10. The footwear item as claimed in claim 9, wherein the thicker parts are made of an elastic material and are locally thinned.

11. The footwear item as claimed in claim 5, wherein the dynamically responsive integral insert is a spring plate with shape memory.

12. The footwear item as claimed in claim 5, wherein the spring plate is fastened by adhesive bonding to the inner face of an outer layer of the sole component.

13. The footwear item as claimed in claim 5, wherein the spring plate comprises at least one V-shaped piece.

14. The footwear item as claimed in claim 5, wherein the spring plate comprises at least two V-shaped pieces assembled in opposition.

15. The footwear item as claimed in claim 2, wherein the resilient weight supporting elements are independent of one another.

16. The footwear item as claimed in claim 2, wherein the resilient weight supporting elements are mechanically integral.

17. The footwear item as claimed in claim 2, wherein a structure of the sole component is a multi-component structure.

18. The footwear item as claimed in claim 2, wherein a structure of the sole component is a one-piece structure.

* * * * *